US011796933B2

(12) United States Patent
Yamakoshi et al.

(10) Patent No.: US 11,796,933 B2
(45) Date of Patent: Oct. 24, 2023

(54) CONDUCTIVE MEMBER, CHARGING DEVICE, PROCESS CARTRIDGE, AND IMAGE FORMING APPARATUS

(71) Applicant: FUJIFILM Business Innovation Corp., Tokyo (JP)

(72) Inventors: Kenta Yamakoshi, Kanagawa (JP); Yukimi Kawabata, Kanagawa (JP); Fuyuki Kano, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/940,528

(22) Filed: Sep. 8, 2022

(65) Prior Publication Data

US 2023/0288833 A1 Sep. 14, 2023

(30) Foreign Application Priority Data

Mar. 14, 2022 (JP) ..... 2022-039591

(51) Int. Cl.
*G03G 15/02* (2006.01)

(52) U.S. Cl.
CPC ..... *G03G 15/0233* (2013.01)

(58) Field of Classification Search
CPC ..... G03G 15/0233
See application file for complete search history.

(56) References Cited

U.S. PATENT DOCUMENTS

| | | | | |
|---|---|---|---|---|
| 8,275,293 | B2 | 9/2012 | Ono | |
| 9,720,343 | B2 | 8/2017 | Kamijo et al. | |
| 2011/0013939 | A1* | 1/2011 | Ono | G03G 15/0233 399/176 |
| 2016/0103401 | A1* | 4/2016 | Kanno | G03G 9/08708 399/130 |
| 2017/0003616 | A1* | 1/2017 | Kamijo | G03G 15/0233 |
| 2022/0234326 | A1* | 7/2022 | Yamanaka | G03G 9/09364 |
| 2022/0373936 | A1* | 11/2022 | Sugiura | G03G 15/161 |
| 2022/0373939 | A1* | 11/2022 | Tanaka | G03G 15/162 |

FOREIGN PATENT DOCUMENTS

| | | | |
|---|---|---|---|
| JP | 2011-22410 A | | 2/2011 |
| JP | 2016118647 A | * | 6/2016 |
| JP | 2017-15952 A | | 1/2017 |

* cited by examiner

*Primary Examiner* — Ryan D Walsh
(74) *Attorney, Agent, or Firm* — Sughrue Mion, PLLC

(57) ABSTRACT

A conductive member includes a substrate, an elastic layer on the substrate, and a surface layer on the elastic layer. The surface layer contains a conductive agent and has a sea-island structure including a sea containing a first resin and islands containing a second resin. The area occupancy of the islands in a cross section of the surface layer is 10% or more and 50% or less.

5 Claims, 3 Drawing Sheets

CONDUCTIVE MEMBER, CHARGING DEVICE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2022-039591 Mar. 14, 2022.

BACKGROUND

(i) Technical Field

The present disclosure relates to a conductive member, a charging device, a process cartridge, and an image forming apparatus.

(ii) Related Art

Japanese Unexamined Patent Application Publication No. 2011-022410 proposes a "conductive member including: a substrate; an elastic layer disposed on the substrate; and a surface layer disposed on the elastic layer, having a sea-island structure including a sea containing a first resin and islands containing a second resin, and containing carbon black inside at least the islands".

Japanese Unexamined Patent Application Publication No. 2017-15952 proposes a "conductive member including: a substrate; an elastic layer disposed on the substrate; and a surface layer disposed on the elastic layer, wherein the surface layer has a sea-island structure including a sea containing at least a first resin and a conductive agent and islands containing at least a second resin, the islands have an average diameter of 100 nm or more and 1/10 the thickness of the surface layer or less, and the conductive agent contained in the sea is localized near the interface between the sea and the islands".

SUMMARY

Aspects of non-limiting embodiments of the present disclosure relate to a conductive member including a substrate, an elastic layer on the substrate, and a surface layer on the elastic layer, wherein the surface layer contains a conductive agent and has a sea-island structure including a sea containing a first resin and islands containing a second resin. The conductive member eliminates or reduces color streaks in the axial direction generated during image formation and has a surface layer that is less likely to break even if repeatedly deformed, compared with a conductive member in which the area occupancy of the islands in the cross section of the surface layer is less than 10% or more than 50%, or the diameter of the islands in the cross section of the surface layer is less than 100 nm or more than 750 nm.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a conductive member including a substrate, an elastic layer on the substrate, and a surface layer on the elastic layer, wherein the surface layer contains a conductive agent and has a sea-island structure including a sea containing a first resin and islands containing a second resin, and the area occupancy of the islands in a cross section of the surface layer is 10% or more and 50% or less.

BRIEF DESCRIPTION OF THE DRAWINGS

Exemplary embodiments of the present disclosure will be described in detail based on the following figures, wherein.

DETAILED DESCRIPTION

Figure 1:
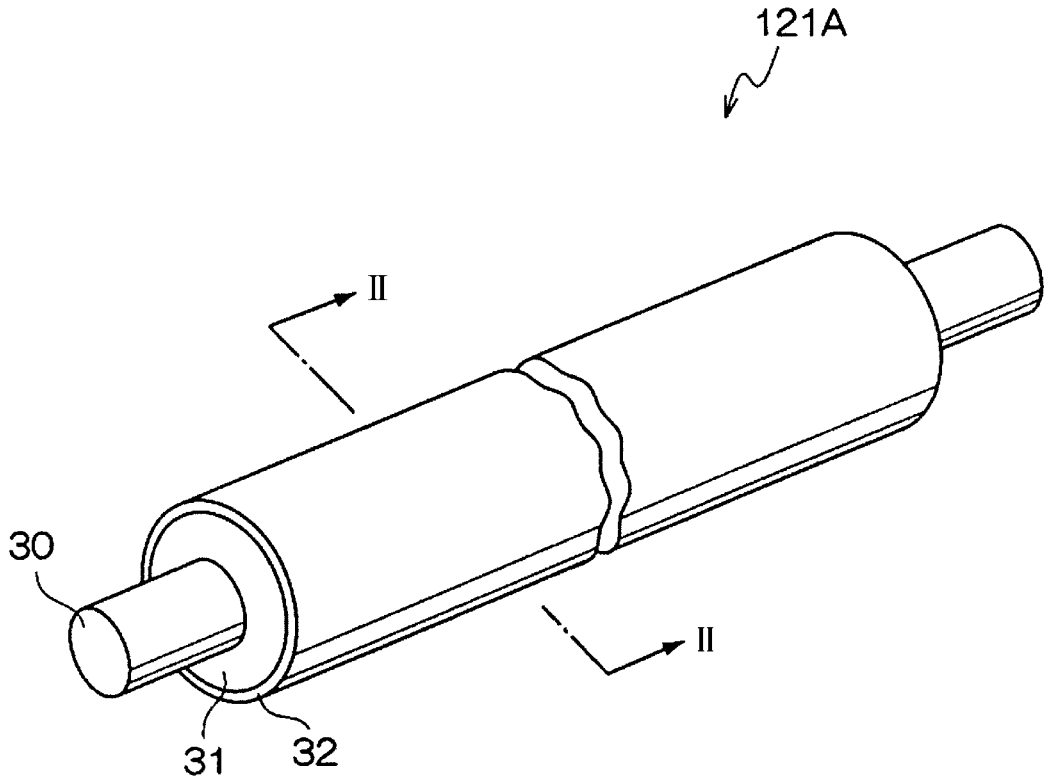
FIG. 1 is a schematic perspective view of an example of a conductive member according to an exemplary embodiment.

Exemplary embodiments of the present disclosure will be described below. The following description and Examples are for illustrating the exemplary embodiments, but are not intended to limit the scope of the present disclosure.

With regard to value ranges described stepwise in this specification, the upper limit or the lower limit of one value range may be replaced by the upper limit or the lower limit of another value range. The upper limit or lower limit of any value range described in this specification may be replaced by a value described in Examples.

Each component may include two or more corresponding substances.

The amount of each component in a composition refers to, when there are two or more substances corresponding to each component in the composition, the total amount of the substances present in the composition, unless otherwise specified.

Conductive Member

The conductive member according to a first exemplary embodiment includes a substrate, an elastic layer on the substrate, and a surface layer on the elastic layer.

The surface layer contains a conductive agent and has a sea-island structure including a sea containing a first resin and islands containing a second resin. The area occupancy of the islands in the cross section of the surface layer (hereinafter referred to simply as an "area occupancy of the islands") is 10% or more and 50% or less.

Having the foregoing configuration, the conductive member according to the first exemplary embodiment may eliminate or reduce color streaks (e.g., unintended linear images) in the axial direction generated during image formation and may have a surface layer that is less likely to break even if repeatedly deformed. The reason for this is assumed as described below.

Color streaks may be easily generated in the axial direction when images are formed by using a conductive member including a substrate, an elastic layer on the substrate, and a surface layer on the elastic layer, wherein the surface layer contains a conductive agent and has a sea-island structure including a sea containing a first resin and islands containing a second resin. This may result from few conduction paths in the surface layer.

In the conductive member according to the first exemplary embodiment, the area occupancy of the islands in the cross section of the surface layer is 10% or more and 50% or less. When the area occupancy of the islands in the cross section of the surface layer is 10% or more, the islands occupy a large region of the surface layer. The islands may thus be spaced apart from each other at short distances in the surface layer. In the surface layer containing a conductive agent and having a sea-island structure including a sea containing a first resin and islands containing a second resin, the conductive agent may tend to be localized near the regions of the islands. Shortening the distance between the islands may tend to increase conduction paths in the surface layer.

When the area occupancy of the islands in the cross section of the surface layer is 50% or less, the surface layer does not contain an excessive amount of the second resin. This configuration may prevent breakage of the surface layer caused by cracking at the interface between the islands and the sea. The conductive member may thus have a surface layer that is less likely to break even if repeatedly deformed.

Having the foregoing configuration, the conductive member according to the first exemplary embodiment is assumed to eliminate or reduce color streaks in the axial direction generated during image formation and have a surface layer that is less likely to break even if repeatedly deformed, as described above.

A conductive member according to a second exemplary embodiment includes a substrate, an elastic layer on the substrate, and a surface layer on the elastic layer.

The surface layer contains a conductive agent and has a sea-island structure including a sea containing a first resin and islands containing a second resin. The diameter of the islands in the cross section of the surface layer (hereinafter referred to simply as the "diameter of the islands") is 100 nm or more and 750 nm or less.

Having the foregoing configuration, the conductive member according to the second exemplary embodiment is assumed to eliminate or reduce color streaks in the axial direction generated during image formation and have a surface layer that is less likely to break even if repeatedly deformed. The reason for this is assumed as described below.

In the conductive member according to the second exemplary embodiment, the diameter of the islands in the cross section of the surface layer is 100 nm or more and 750 nm or less. When the diameter of the islands in the cross section of the surface layer is 100 nm or more, the islands occupy a large region of the surface layer. The islands may thus tend to be spaced apart from each other at short distances in the surface layer to provide many conduction paths in the surface layer.

When the diameter of the islands in the cross section of the surface layer is 750 nm or less, the size of the islands in the surface layer is not excessively large. This configuration may prevent breakage of the surface layer caused by cracking at the interface between the islands and the sea. The conductive member may thus have a surface layer that is less likely to break even if repeatedly deformed.

Having the foregoing configuration, the conductive member according to the second exemplary embodiment is assumed to eliminate or reduce color streaks in the axial direction generated during image formation and have a surface layer that is less likely to break even if repeatedly deformed.

When the amount of the second resin with respect to the amount of the first resin is in a suitable value range described below, a conductive member in which the area occupancy of the islands is 10% or more and 50% or less and a conductive member in which the diameter of the islands is 100 nm or more and 750 nm or less are easily obtained.

The conductive member corresponding to the conductive members according to the first and second exemplary embodiments will be specifically described below. An example of the conductive member of the present disclosure is a conductive member corresponding to the conductive member according to any one of the first and second exemplary embodiments.

Figure 2:
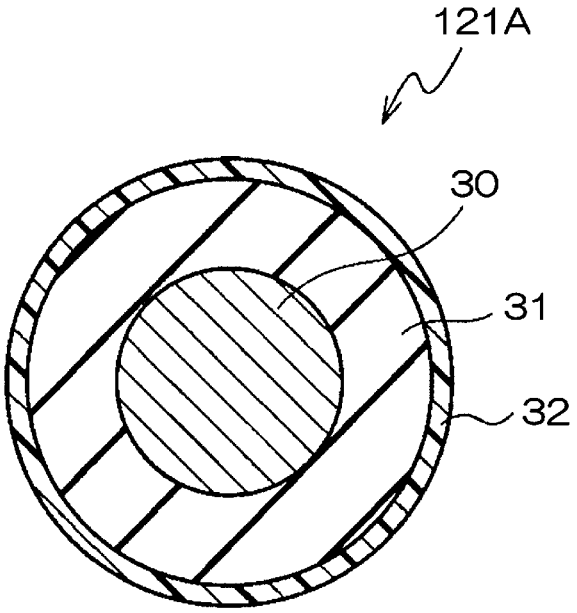
FIG. 2 is a schematic cross-sectional view of the example of the conductive member according to the exemplary embodiment taken along line II-II in FIG. 1.

FIG. 1 is a schematic perspective view of an example of the conductive member according to the exemplary embodiment. FIG. 2 is a schematic cross-sectional view of the example of the conductive member according to the exemplary embodiment. FIG. 2 is a cross-sectional view taken along line II-II in FIG. 1.

Referring to FIG. 1 and FIG. 2, a conductive member 121A according to an exemplary embodiment is a roll-shaped member including, for example, a shaft 30 (an example of the substrate), an elastic layer 31 disposed on the outer circumferential surface of the shaft 30, and a surface layer 32 disposed on the outer circumferential surface of the elastic layer 31.

An example of the conductive member according to the present disclosure will be described below, but the reference signs of the components may be omitted.

Substrate

The substrate is a conductive cylindrical or columnar member. The term conductive as used herein refers to a volume resistivity of less than $10^{13}$ Ωcm.

Examples of the material of the substrate include metals, such as iron (e.g., free-cutting steel), copper, brass, stainless steel, aluminum, and nickel. Examples of the substrate include a member (e.g., resin or ceramic member) having a plated outer circumferential surface, and a member (e.g., resin or ceramic member) containing a conductive agent dispersed therein.

Elastic Layer

The elastic layer contains, for example, an elastic material, a conductive agent, and other additives.

Examples of the elastic material include isoprene rubber, chloroprene rubber, epichlorohydrin rubber, butyl rubber, polyurethane, silicone rubber, fluororubber, styrene-butadiene rubber, butadiene rubber, nitrile rubber, ethylene propylene rubber, epichlorohydrin-ethylene oxide copolymer rubber, epichlorohydrin-ethylene oxide-allyl glycidyl ether copolymer rubber, ethylene-propylene-diene ternary copolymer rubber (EPDM), acrylonitrile-butadiene copolymer rubber (NBR), natural rubbers, and blended rubbers thereof. Of these elastic materials, polyurethane, silicone rubber, EPDM, epichlorohydrin-ethylene oxide copolymer rubber, epichlorohydrin-ethylene oxide-allyl glycidyl ether copolymer rubber, NBR, and blended rubbers thereof may be used. These elastic materials may be foamed rubbers or non-foamed rubbers.

Examples of the conductive agent include electroconductive agents and ion conductive agents. Examples of electroconductive agents include powders made of carbon black, such as Ketjenblack and acetylene black; powders made of pyrolytic carbon or graphite; powders made of conductive metals or alloys, such as aluminum, copper, nickel, and stainless steel; powders made of conductive metal oxides, such as tin oxide, indium oxide, titanium oxide, tin oxide-antimony oxide solid solution, and tin oxide-indium oxide solid solution; and powders made of an insulating material with a conductive surface. Examples of ion conductive agents include perchlorates and chlorates of oniums, such as tetraethylammonium and lauryltrimethylammonium; perchlorates and chlorates of alkali metals and alkaline earth metals, such as lithium and magnesium. The conductive agent may be used alone or in combination of two or more.

Specific examples of carbon black include "Special Black 350", "Special Black 100", "Special Black 250", "Special Black 5", "Special Black 4", "Special Black 4A", "Special Black 550", "Special Black 6", "Color Black FW200", "Color Black FW2", and "Color Black FW2V", all available from Orion Engineered Carbons; and "MONARCH 880", "MONARCH 1000", "MONARCH 1300", "MONARCH 1400", "MOGUL-L", and "REGAL 400R", all available from Cabot Corporation.

The amount of the conductive agent is not limited. In the case of electroconductive agent, the amount of the conductive agent is preferably in the range of 1 part by mass or more and 30 parts by mass or less, more preferably in the range of 15 parts by mass or more and 25 parts by mass or less with respect to 100 parts by mass of the elastic material. In the case of ion conductive agent, the amount of the conductive agent is preferably in the range of 0.1 parts by mass or more and 5.0 parts by mass or less, more preferably in the range of 0.5 parts by mass or more and 3.0 parts by mass or less with respect to 100 parts by mass of the elastic material.

Examples of other additives added to the elastic layer include common materials that may be added to the elastic layer, such as softeners, plasticizers, curing agents, vulcanizing agents, vulcanization accelerators, antioxidants, surfactants, coupling agents, and fillers (e.g., silica, calcium carbonate).

The average thickness of the elastic layer is preferably about 1 mm or more and about 15 mm or less, more preferably about 2 mm or more and about 10 mm or less.

The volume resistivity of the elastic layer is preferably $10^3$ Ωcm or more and $10^{14}$ Ωcm or less.

Surface Layer

Composition of Surface Layer

The surface layer contains a conductive agent and has a sea-island structure including a sea containing a first resin and islands containing a second resin.

The "sea-island structure" as used herein refers to a structure in which at least two resins are mixed in an incompatible state and in which islands of dispersed phase are contained in a sea of continuous phase.

The sea-island structure is formed by controlling a difference in solubility parameter (SP value) between the first resin and the second resin and the mixing ratio between the first resin and the second resin. The difference in SP value between the first resin and the second resin is preferably 2 or more and 10 or less in view of ease in forming the sea-island structure.

The mixing ratio between the first resin and the second resin will be described below.

The method for calculating the solubility parameter (SP value) in the exemplary embodiment is described in "Polymer Handbook, 4th edition, John Wiley & Sons", VII 680 to 683. The solubility parameters of main resins are described in VII 702 to 711 in this document.

Examples of the first resin include acrylic resin, cellulose resin, polyamide resin, copolymer Nylons, polyurethane resin, polycarbonate resin, polyester resin, polyethylene resin, polyvinyl resin, polyarylate resin, styrene butadiene resin, melamine resin, epoxy resin, urethane resin, silicone resin, fluororesins (e.g., tetrafluoroethylene perfluoroalkyl vinyl ether copolymer, ethylene tetrafluoride-propylene hexafluoride copolymer, and polyvinylidene fluoride), and urea resin. Copolymer Nylons are copolymers including, as polymer unit(s), one or two or more of Nylon 610, Nylon 11, and Nylon 12 and may include, for example, Nylon 6 and Nylon 66 as other polymer units. The elastic material added to the elastic layer may be used as the first resin. The first resin may be one resin or a combination of two or more resins.

The first resin is preferably a polyamide resin (e.g., Nylon), more preferably a methoxymethylated polyamide resin (e.g., methoxymethylated nylon) in view of, for example, the electrical properties of the surface layer or the resistance to contamination; the appropriate hardness of the surface layer attributed to disposition of the surface layer on the elastic layer, or maintainability; and conductive agent dispersion suitability or coating film formability in the case of forming the surface layer using a dispersion solution.

Examples of the second resin include polyvinyl butyral resin, polystyrene resin, and polyvinyl alcohol. The second resin may be one resin or a combination of two or more resins.

The second resin may be a polyvinyl butyral resin in view of, for example, the electrical properties of the surface layer or the resistance to contamination; the appropriate hardness of the surface layer attributed to disposition of the surface layer on the elastic layer, or maintainability; and conductive agent dispersion suitability or coating film formability in the case of forming the surface layer using a dispersion solution.

Examples of the conductive agent include electroconductive agents and ion conductive agents. Examples of electroconductive agents include powders made of carbon black, such as Ketjenblack and acetylene black; powders made of pyrolytic carbon or graphite; powders made of conductive metals or alloys, such as aluminum, copper, nickel, and stainless steel; powders made of conductive metal oxides, such as tin oxide, indium oxide, titanium oxide, tin oxide-antimony oxide solid solution, and tin oxide-indium oxide solid solution; and powders made of an insulating material with a conductive surface. Examples of ion conductive agents include perchlorates and chlorates of oniums, such as tetraethylammonium and lauryltrimethylammonium; perchlorates and chlorates of alkali metals and alkaline earth metals, such as lithium and magnesium. The conductive agent may be used alone or in combination of two or more.

The conductive agent is preferably carbon black.

The use of carbon black as the conductive agent may be more likely to allow the conductive member to eliminate or reduce color streaks in the axial direction generated during image formation. The reason for this is assumed as described below.

Carbon black is more easily localized near the regions of the islands in the surface layer than conductive agents other than carbon black. When the area occupancy of the islands is 10% or more and 50% or less, and the diameter of the islands is 100 nm or more and 750 nm or less, the surface layer may have more conduction paths.

The use of carbon black as the conductive agent thus tends to allow the conductive member to eliminate or reduce color streaks in the axial direction generated during image formation.

Examples of carbon black include Ketjenblack, acetylene black, and oxidized carbon black of pH 5 or less. Specific examples of carbon black include "Special Black 350", "Special Black 100", "Special Black 250", "Special Black 5", "Special Black 4", "Special Black 4A", "Special Black 550", "Special Black 6", "Color Black FW200", "Color Black FW2", and "Color Black FW2V", all available from Orion Engineered Carbons; and "MONARCH 880", "MON- ARCH 1000", "MONARCH 1300", "MONARCH 1400", "MOGUL-L", and "REGAL 400R", all available from Cabot Corporation.

The average particle size of carbon black is preferably 15 nm or more and 30 nm or less, more preferably 15 nm or more and 25 nm or less, still more preferably 15 nm or more and 20 nm or less.

When the average particle size of carbon black is 15 nm or more and 30 nm or less, the conductive member may be more likely to eliminate or reduce color streaks in the axial direction generated during image formation. The reason for this is assumed as described below.

When the average particle size of carbon black is 15 nm or more and 30 nm or less, carbon black particles may tend to be more densely localized near the regions of the islands in the surface layer. This may further facilitate current flow between the particles of the conductive agent. When the area occupancy of the islands is 10% or more and 50% or less, and the diameter of the islands is 100 nm or more and 750 nm or less, the surface layer may have more conduction paths.

The conductive member may thus be more likely to eliminate or reduce color streaks in the axial direction generated during image formation.

The average particle size of carbon black is measured with a transmission electron microscope (TEM).

The measurement method is as described below.

First, the surface layer is cut with a microtome, and the obtained cross section is observed with a transmission electron microscope (TEM). The diameter of a circle with an area equivalent to the projected area of each of 50 carbon black particles is defined as the particle size, and the average value of the particle size is defined as the average particle size.

The amount of the conductive agent may be 10 parts by mass or more and 15 parts by mass or less with respect to 100 parts by mass of the total amount of the first resin and the second resin.

When the amount of the conductive agent may be 10 parts by mass or more and 15 parts by mass or less with respect to 100 parts by mass of the total amount of the first resin and the second resin, the conductive member may be more likely to eliminate or reduce color streaks in the axial direction generated during image formation. The reason for this is assumed as described below.

When the amount of the conductive agent is 10 parts by mass or more with respect to 100 parts by mass of the total amount of the first resin and the second resin, the surface layer contains a large amount of the conductive agent. The particles of the conductive agent may be more likely to be in close proximity to each other, which may further facilitate current flow between the particles of the conductive agent. When the area occupancy of the islands is 10% or more and 50% or less, and the diameter of the islands is 100 nm or more and 750 nm or less, the surface layer may have more conduction paths.

When the amount of the conductive agent is 15 parts by mass or less with respect to 100 parts by mass of the total amount of the first resin and the second resin, the particles of the conductive agent may be less likely to be dotted throughout the sea contained in the surface layer, which may suppress a decrease in conductive effect caused by dispersion of conduction paths.

The conductive member may thus be more likely to eliminate or reduce color streaks in the axial direction generated during image formation.

The amount of the second resin with respect to 100 parts by mass of the total amount of the first resin and the second resin is preferably 10 parts by mass or more and 30 parts by mass or less, more preferably 15 parts by mass or more and 25 parts by mass or less, still more preferably 20 parts by mass or more and 25 parts by mass or less.

When the amount of the second resin is 10 parts by mass or more and 30 parts by mass or less with respect to 100 parts by mass of the total amount of the first resin and the second resin, the conductive member may be more likely to eliminate or reduce color streaks in the axial direction generated during image formation and may be more likely to have a surface layer that is less likely to break even if repeatedly deformed. The reason for this is assumed as described below.

When the amount of the second resin is 10 parts by mass or more with respect to 100 parts by mass of the total amount of the first resin and the second resin, the area occupancy of the islands and the diameter of the islands may tend to fall in suitable value ranges. This configuration may tend to further increase the conduction paths in the surface layer. When the amount of the second resin is 30 parts by mass or less with respect to the entire surface layer, this configuration may prevent breakage of the surface layer caused by cracking at the interface between the islands and the sea. The conductive member may thus have a surface layer that is less likely to break even if further repeatedly deformed.

The conductive member may thus be more likely to eliminate or reduce color streaks in the axial direction generated during image formation and may be more likely to have a surface layer that is less likely to break even if repeatedly deformed.

The amount of the second resin with respect to 100 parts by mass of the first resin is preferably 11 parts by mass or more and 43 parts by mass or less, more preferably 15 parts by mass or more and 35 parts by mass or less, still more preferably 20 parts by mass or more and 35 parts by mass or less.

When the amount of the second resin is 11 parts by mass or more and 43 parts by mass or less with respect to 100 parts by mass of the first resin, the conductive member may be more likely to eliminate or reduce color streaks in the axial direction generated during image formation and may be more likely to have a surface layer that is less likely to break even if repeatedly deformed. The reason for this is assumed as described below.

When the amount of the second resin is 11 parts by mass or more and 43 parts by mass or less with respect to 100 parts by mass of the first resin, the sea-island structure may tend to form, and the area occupancy of the islands and the diameter of the islands may tend to be in suitable value ranges. This configuration may tend to further increase the conduction paths in the surface layer and may further prevent breakage of the surface layer caused by cracking at the interface between the islands and the sea.

The conductive member may thus be more likely to eliminate or reduce color streaks in the axial direction generated during image formation and may be more likely to have a surface layer that is less likely to break even if repeatedly deformed.

To eliminate or reduce color streaks and improve breakage resistance, the total amount of the first resin and the second resin with respect to the entire surface layer is preferably 50 mass % or more and 95 mass % or less, more preferably 60 mass % or more and 90 mass % or less, still more preferably 70 mass % or more and 85 mass % or less.

Area Occupancy of Islands

In the conductive member according to the exemplary embodiment, the area occupancy of the islands in the cross section of the surface layer is 10% or more and 50% or less. To further eliminate or reduce color streaks in the axial direction generated during image formation and to provide a surface layer that is less likely to break even if repeatedly deformed, the area occupancy of the islands in the cross section of the surface layer is preferably 10% or more and 45% or less, more preferably 15% or more and 40% or less, still more preferably 15% or more and 35% or less, particularly preferably 15% or more and 25% or less.

The area occupancy of the islands is measured as described below.

A section sample of the surface layer cut in the thickness direction is prepared by the cryo-microtome method. The cross section of the surface layer of the section sample cut by the cryo-microtome method is observed with a scanning electron microscope. Ten regions of 4 μm×4 μm square including the sea and the islands are freely selected. The area of the islands in each of the regions is measured, and the measured area is defined as the area occupancy of the islands.

If the thickness of the surface layer is less than 4 μm, more regions are observed such that the observed regions have the same area as the observation area described above (specifically 160 $\mu m^2$)

Diameter of Islands

In the conductive member according to the exemplary embodiment, the diameter of the islands in the cross section of the surface layer is 100 nm or more and 750 nm or less. To further eliminate or reduce color streaks in the axial direction generated during image formation and to provide a surface layer that is less likely to break even if repeatedly deformed, the diameter of the islands in the cross section of the surface layer is 150 nm or more and 650 nm or less, more preferably 200 nm or more and 600 nm or less, still more preferably 300 nm or more and 400 nm or less.

The diameter of the islands is measured as described below.

A section sample of the surface layer cut in the thickness direction is prepared by the cryo-microtome method. The cross section of the surface layer of the section sample cut by the cryo-microtome method is observed with a scanning electron microscope. Ten islands are freely selected. The maximum length (e.g., major axis) between two freely selected points on the outline of each of 10 islands is measured, and the average value of the major axes of 10 islands is defined as the diameter (nm) of the islands.

Thickness of Surface Layer

The thickness of the surface layer is preferably 3 μm or more and 25 μm or less, more preferably 5 μm or more and 20 μm or less, still more preferably 6 μm or more and 15 μm or less.

The thickness of the surface layer is measured by cutting the surface layer in the thickness direction and observing the obtained cross section with an optical microscope.

Average Current Value of Conductive Member

The average current value of the conductive member according to the exemplary embodiment is preferably $4.0\times10^3$ μA or more, more preferably $4.5\times10^3$ μA or more and $2.0\times10^6$ μA or less, still more preferably $5.0\times10^3$ μA or more and $1.5\times10^6$ μA or less.

The conductive member with an average current value of $4.0\times10^3$ μA or more may be more likely to eliminate or reduce color streaks in the axial direction generated during image formation. The reason for this is assumed as described below.

An average current value of $4.0\times10^3$ μA or more indicates that current easily flows through the surface layer. The surface layer in this state indicates the surface layer has many conduction paths.

The conductive member may thus be more likely to eliminate or reduce color streaks in the axial direction generated during image formation.

The average current value is measured as described below.

The conductive member is left to stand in an environment at a temperature of 23±2° C. and a relative humidity of 50±5% for 24 hours or longer, and the average current value is then measured in this environment. There are total 12 measurement points in the conductive member, 3 points in the axial direction (near the opposite ends and at central portion)×4 points at 90° intervals in the circumferential direction. The measurement area of each measurement point is a 50 μm×50 μm square (a square with two sides parallel to the axial direction of the conductive member) on the outer circumferential surface of the surface layer. The current value is measured by bringing a conical probe (made of tungsten) with a tip diameter of 20 nm into contact with the outer circumferential surface of the surface layer to apply a voltage of 3V between the conical probe and the conductive member, and moving the conical probe in the axial direction of the conductive member at a speed of 1 μm/sec. The current value in the entire region of 50 μm square is measured by repeating the measurement while moving the conical probe in the circumferential direction of the conductive member.

The total current value flowing through the area of 50 μm square is determined by the measurement described above, and the sum of the current values at all measurement points (12 points) is averaged to provide an average current value (μA).

Method for Producing Conductive Member

An example method for producing a conductive member according to an exemplary embodiment will be described below.

A roll-shaped member having an elastic layer on the outer circumferential surface of a cylindrical or columnar substrate is prepared. The roll-shaped member may be produced by any method. An example method for producing the roll-shaped member may involve applying a mixture containing a rubber material and as desired, a conductive agent and other additives around the substrate, and performing vulcanization by heating to form an elastic layer.

A method for forming the surface layer on the outer circumferential surface of the elastic layer is not limited and may involve applying, to the outer circumferential surface of the elastic layer, a dispersion containing the first resin, the second resin, and the conductive agent dissolved and dispersed in a solvent, and drying the applied dispersion. Examples of the method for applying the dispersion include a blade coating method, a Mayer bar coating method, a spray coating method, a dip coating method, a bead coating method, an air knife coating method, and a curtain coating method.

Application of Conductive Member

The conductive member according to the exemplary embodiment is used as, for example, a charging roller for charging the surface of an image holding member in an electrophotographic copier, an electrostatic printer, or other devices; a transfer roller for transferring a toner image on the image holding member to a transfer medium; a toner conveying roller for conveying a toner to the image holding member; a conductive roller for power supply or driving in combination with a conductive belt that electrostatically conveys a sheet of paper; and a cleaning roller for removing the toner on the image holding member. The conductive member according to the exemplary embodiment is also used as a power supply roller for charging an intermediate transfer body before ink is ejected from an ink jet head in an ink-jet image forming apparatus.

The configuration of the conductive member 121A, a roll-shaped member, serving as the conductive member according to the exemplary embodiment is described above. The conductive member according to the exemplary embodiment is not limited to the roll-shaped member, and may be an endless belt-shaped member or a sheet-shaped member.

The conductive member according to the exemplary embodiment may include, for example, an adhesive layer (primer layer) between the substrate and the elastic layer, a resistance adjusting layer or transfer preventing layer between the elastic layer and the surface layer, and a coating layer (protective layer) on the outside (outermost surface) of the surface layer.

Charging Device, Image Forming Apparatus, and Process Cartridge

A charging device according to an exemplary embodiment includes the conductive member according to the exemplary embodiment.

The charging device according to the exemplary embodiment may include the conductive member according to the exemplary embodiment and may charge an image holding member by contact charging.

The contact width between the conductive member and the image holding member in the circumferential direction of the conductive member (e.g., the width of a region of the conductive member in contact with the image holding member in the circumferential direction of the conductive member) is not limited and is, for example, in the range of 0.5 mm or more and 5 mm or less, preferably in the range of 1 mm or more and 3 mm or less.

A process cartridge according to an exemplary embodiment includes a charging device that is attachable to and detachable from an image forming apparatus having the following configuration and that charges the surface of the image holding member. The process cartridge according to the exemplary embodiment includes the charging device according to the exemplary embodiment as a charging device.

The process cartridge according to the exemplary embodiment may include, as desired, for example, at least one selected from the group consisting of an image holding member, an electrostatic latent image-forming device that forms an electrostatic latent image on the charged surface of the image holding member, a developing device that develops the latent image on the surface of the image holding member to form a toner image, a transfer device that transfers a toner image on the surface of the image holding member to a recording medium, and a cleaning device that cleans the surface of the image holding member.

An image forming apparatus according to an exemplary embodiment includes: an image holding member; a charging device that charges the surface of the image holding member; an electrostatic latent image-forming device that forms an electrostatic charge image on the charged surface of the image holding member; a developing device that develops the electrostatic latent image on the surface of the image holding member by using a developer containing a toner to form a toner image; and a transfer device that transfers the toner image to the surface of a recording medium. The image forming apparatus according to the exemplary embodiment includes the charging device according to the exemplary embodiment as a charging device.

Next, the image forming apparatus and the process cartridge according to the exemplary embodiments will be described with reference to the drawings.

Figure 3:
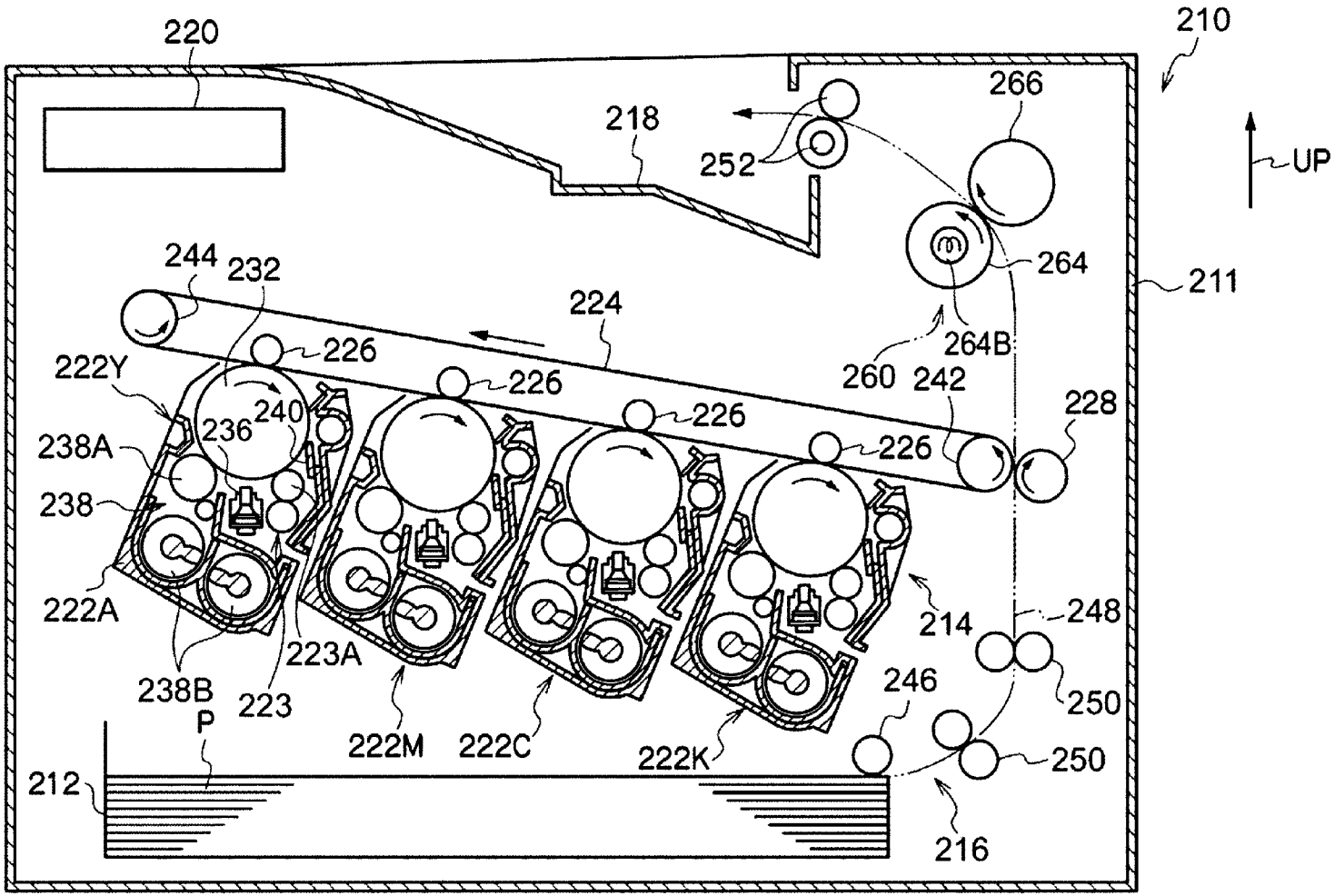
FIG. 3 is a schematic structural view of an example of an image forming apparatus according to an exemplary embodiment.

FIG. 3 is a schematic structural view of the image forming apparatus according to the exemplary embodiment. The arrow UP shown in the figure indicates the vertically upward direction.

Referring to FIG. 3, an image forming apparatus 210 includes an image forming apparatus body 211 accommodating components inside. The image forming apparatus body 211 accommodates a storage unit 212 that stores a recording medium P, such as a sheet of paper, an image forming unit 214 that forms an image on the recording medium P, a conveying unit 216 that conveys the recording medium P to the image forming unit 214 from the storage unit 212, and a controller 220 that controls the operation of each part of the image forming apparatus 210. A discharge unit 218 is provided in an upper part of the image forming apparatus body 211. The recording medium P having the image formed by the image forming unit 214 is discharged to the discharge unit 218.

The image forming unit 214 includes: image forming units 222Y, 222M, 222C, and 222K (hereinafter referred to as 222Y to 222K) that form toner images of respective colors, yellow (Y), magenta (M), cyan (C), and black (K); an intermediate transfer belt 224 (an example of an object that receives transferred images) to which the toner images formed by the image forming units 222Y to 222K are transferred; a first transfer roller 226 (an example of the transfer roll) that transfers the toner images formed by the image forming units 222Y to 222K to the intermediate transfer belt 224; and a second transfer roller 228 (an example of the transfer member) that transfers the toner images, which have been transferred to the intermediate transfer belt 224 by the first transfer roller 226, to the recording medium P from the intermediate transfer belt 224. The image forming unit 214 is not limited to the above configuration and may have other configurations as long as the image forming unit 214 forms an image on the recording medium P (an example of a transfer object).

A unit including the intermediate transfer belt 224, the first transfer roller 226, and the second transfer roller 228 corresponds to an example of the transfer device. The unit may be configured as a cartridge (process cartridge).

The image forming units 222Y to 222K are arranged in a vertically central area of the image forming apparatus 210 while being inclined with respect to the horizontal direction. The image forming units 222Y to 222K each have a photoreceptor 232 (an example of an image holding member).

The photoreceptor 232 rotates in one direction (e.g., clockwise in FIG. 3). Since the image forming units 222Y to 222K have the same structure, the reference signs of the components of the image forming units 222M, 222C, and 222K are omitted in FIG. 3.

The photoreceptor 232 is surrounded by, in sequence from the upstream side in the rotation direction of the photoreceptor 232, a charging device 223 having a charging roller 223A (an example of the charging member) that charges the photoreceptor 232, an exposure device 236 (an example of the electrostatic latent image-forming device) that exposes the photoreceptor 232 charged by the charging device 223 to light to form an electrostatic latent image on the photoreceptor 232, a developing device 238 that develops the latent image, which has been formed on the photoreceptor 232 by the exposure device 236, to form a toner image, and a removing member (e.g., cleaning blade) 240 that comes into contact with the photoreceptor 232 and removes the toner remaining on the photoreceptor 232.

The photoreceptor 232, the charging device 223, the exposure device 236, the developing device 238, and the removing member 240 are integrally held by a housing 222A and configured as a cartridge (process cartridge).

The exposure device 236 has a self-scanning LED print head. The exposure device 236 may be an optical exposure device that exposes the photoreceptor 232 to light from a light source through a polygon mirror.

The exposure device 236 forms a latent image on the basis of an image signal from the controller 220. The image signal from the controller 220 is, for example, an image signal received by the controller 220 from an external device.

The developing device 238 includes a developer supply unit 238A that supplies a developer to the photoreceptor 232, and a plurality of conveying members 238B that convey the developer to the developer supply unit 238A while stirring the developer.

The intermediate transfer belt 224 is formed in a loop shape and located above the image forming units 222Y to 222K. Winding rolls 242 and 244 around which the intermediate transfer belt 224 is wound are disposed on the inner circumferential side of the intermediate transfer belt 224. Rotational driving of one of the winding rolls 242 and 244 causes the intermediate transfer belt 224 to circulate and move (rotate) in one direction (e.g., counterclockwise in FIG. 3) while being in contact with the photoreceptor 232. The winding roller 242 is a counter roller that faces the second transfer roller 228.

The first transfer roller 226 is disposed opposite the photoreceptor 232 across the intermediate transfer belt 224. The first transfer position at which the toner image that has been formed on the photoreceptor 232 is transferred to the intermediate transfer belt 224 is located between the first transfer roller 226 and the photoreceptor 232.

The second transfer roller 228 is disposed opposite the winding roller 242 across the intermediate transfer belt 224. The second transfer position at which the toner image that has been transferred to the intermediate transfer belt 224 is transferred to the recording medium P is located between the second transfer roller 228 and the winding roller 242.

The conveying unit 216 includes a sending roller 246 that sends out a recording medium P stored in the storage unit 212, a conveyance path 248 along which the recording medium P that has been sent out by the sending roller 246 is conveyed, and a plurality of conveying rolls 250 that convey, to the second transfer position, the recording medium P that has been sent out by the sending roller 246 disposed along the conveyance path 248.

A fixing device 260 is disposed downstream of the second transfer position in the conveyance direction. The fixing device 260 fixes, to the recording medium P, the toner image that has been formed on the recording medium P by the image forming unit 214.

The fixing device 260 includes a heating roller 264 that heats the image on the recording medium P and a pressure roller 266 serving as an example of the pressure member. The heating roller 264 has a heat source 264B inside.

A discharge roller 252 is disposed downstream of the fixing device 260 in the conveyance direction. The discharge roller 252 discharges the recording medium P having the toner image fixed thereon to the discharge unit 218.

Next, the image forming operations for forming an image on the recording medium P in the image forming apparatus 210 will be described.

In the image forming apparatus 210, the recording medium P that has been sent out from the storage unit 212 by the sending roller 246 is delivered to the second transfer position by the plurality of conveying rolls 250.

In each of the image forming units 222Y to 222K, the photoreceptor 232 charged by the charging device 223 is exposed to light by the exposure device 236 to form a latent image on the photoreceptor 232. The latent image is developed by the developing device 238 to form a toner image on the photoreceptor 232. The toner images of colors formed in the image forming units 222Y to 222K are superposed on each other on the intermediate transfer belt 224 at the first transfer position to form a color image. The color image that has been formed on the intermediate transfer belt 224 is transferred to the recording medium P at the second transfer position.

The recording medium P to which the toner images have been transferred is conveyed to the fixing device 260, and the transferred toner images are fixed by the fixing device 260. The recording medium P to which the toner images have been fixed is discharged to the discharge unit 218 by the discharge roller 252. A series of image forming operations are performed as described above.

The image forming apparatus 210 according to the exemplary embodiment is not limited to the foregoing structure and may be a well-known image forming apparatus, such as a direct transfer-type image forming apparatus in which toner images formed on the photoreceptors 232 of the image forming units 222Y to 222K are directly transferred to the recording medium P.

EXAMPLES

Examples will be described below, but the present disclosure is not limited to these Examples. In the following description, the units "part" and "%" are both on a mass basis, unless otherwise specified.

Example 1: Production of Conductive Member

Formation of Elastic Layer

A mixture is prepared by adding, to 100 parts by mass of an elastic material (epichlorohydrin-ethylene oxide-allyl glycidyl ether copolymer rubber), 15 parts by mass of a conductive agent A (carbon black, Asahi Thermal available from Asahi Carbon Co., Ltd.), 1 part by mass of a vulcanizing agent (sulfur, 200 mesh available from Tsurumi Chemical Industry Co., Ltd.) to be added to the elastic layer as other additives, and 2.0 parts by mass of a vulcanization accelerator (Nocceler DM available from Ouchi Shinko Chemical Industrial Co., Ltd.) to be added to the elastic layer as other additives. The mixture is kneaded with an open roller to provide an elastic layer-forming composition. The elastic layer-forming composition is wound around the outer circumferential surface of a shaft (substrate), which is made of SUS303 and has a diameter of 8 mm, with an adhesive layer therebetween by using a press forming machine, and heated in a furnace at a temperature of 180° C. for 30 minutes to form an elastic layer with a thickness of 3.5 mm on the shaft. The outer circumferential surface of the elastic layer is ground to provide a conductive elastic roller having a diameter of 14 mm and having an elastic layer with a thickness of 3.0 mm.

Formation of Surface Layer

A dispersion is prepared by diluting, with 85 parts by mass of methanol, 15 parts by mass of a composition containing 90 parts by mass of a polyamide resin (N-methoxymethylated Nylon, F30K available from Nagase ChemteX Corporation) serving as a first resin, 10 parts by mass of a polyvinyl butyral resin (S-LEC BM-1 available from Sekisui Chemical Co., Ltd.) serving as a second resin, 13 parts by mass of carbon black (MONARCH 1000 available from Cabot Corporation) serving as a conductive agent B, 1.0 part by mass of a porous polyamide filler (Orgasol 2001 UDNATI available from Arkema S.A.), 1.0 part by mass of an acid catalyst (NACURE 4167 available from King Industries, Inc.), 0.1 parts by mass of polyether-modified polydimethylsiloxane (BYK307 available from BYK-Gardner GmbH), and dispersing the resulting mixture in a bead mill. The dispersion is applied to the outer circumferential surface of the elastic layer of the obtained conductive elastic roller by dip coating. The dispersion is then subjected to crosslinking with heating at 140° C. for 30 minutes and dried to form a surface layer with a thickness of 10 μm to provide a conductive member. Examples 2 to 20 and Comparative Examples 1 to 4

A conductive member of each Example is produced by the same procedure as in Example 1 except that the type of first resin, the amount of the first resin added, the type of second resin, the amount of the second resin added, the type of conductive agent B, and the amount of the conductive agent B added in (forming the surface layer) are as described in Table 1.

The abbreviations in Table 1 are as described below.

First Resin

PA1: Polyamide resin (F30K available from Nagase ChemteX Corporation)

PI: Polyimide varnish (U-Imide KX available from Unitika Ltd.) Second Resin

PVB1: Polyvinyl butyral resin (S-LEC BM-1 available from Sekisui Chemical Co., Ltd.)

PVA: Polyvinyl alcohol resin (Poval available from Shin-Etsu Astech Co. Ltd.) Conductive Agent CB1: Carbon black (MONARCH 1000 available from Cabot Corporation)

CB2: Carbon black (MONARCH 1500 available from Cabot Corporation)

CB3: Carbon black (MONARCH 1400 available from Cabot Corporation)

CB4: Carbon black (MONARCH 460 available from Cabot Corporation)

CB5: Carbon black (REGAL 250R available from Cabot Corporation)

Tin oxide: Tin oxide (tin oxide (IV) available from Hayashi Pure Chemical Ind., Ltd.)

The "area occupancy of islands", "average current value", "average particle size of carbon black (in Table 2, referred to simply as "average particle size (nm)")", and "diameter of islands" of the conductive member produced in each Example are measured in accordance with the methods described above. The obtained results are shown in Table 2.

In the case where the conductive agent contained in the surface layer is not carbon black, the "average particle size (nm)" in Table 2 indicates the average particle size of the conductive agent measured by the same method as the method for measuring the average particle size of carbon black described above.

Evaluation

Evaluation of Image

The conductive member produced in Example or Comparative Example described above is installed into a modified machine of an image forming apparatus (DocuCentre-V C7776 available from FUJIFILM Business Innovation Corporation), and an A4 image with an area coverage of 30% is outputted on 5000 sheets under the conditions of 28° C. and 85% RH. The image is rated G0 to G3 according to the level of color streaks outputted and appearing on the 5000th sheet and extending in the axial direction of the photoreceptor. G0 to G2 are practically acceptable levels. The evaluation results are shown in Table 2.

G0: There are no color streaks extending in the axial direction of the photoreceptor.

G0.5: There are 1 or less color streaks extending in the axial direction of the photoreceptor.

G1: There are 2 or more and 4 or less color streaks extending in the axial direction of the photoreceptor.

G1.5: There are 5 or more and 7 or less color streaks extending in the axial direction of the photoreceptor.

G2: There are 8 or more and 10 or less color streaks extending in the axial direction of the photoreceptor.

G2.5: There are 11 or more and 13 or less color streaks extending in the axial direction of the photoreceptor.

G3: There are 14 or more color streaks extending in the axial direction of the photoreceptor.

Evaluation of Strength

The strength of the surface layer is evaluated by the MIT test.

The MIT test conforms to JIS P 8115: 2001 (MIT method).

Specifically, a strip-shaped test piece with a width of 15 mm and a length of 200 mm in the circumferential direction (the thickness of the test piece corresponds to the thickness of the surface layer) is cut out from the surface layer of the conductive member. While a tension of 1 kgf is applied to the strip-shaped test piece with the opposite ends thereof fixed, the test piece is repeatedly bent (folded) 90° to and from with a clamp having a curvature radius R of 0.05 serving as a pivot. The number of times the strip-shaped test piece has been bent until the test piece fractures is defined as a folding endurance number, and the strength is evaluated according to the following evaluation criteria based on the folding endurance number.

The MIT test is carried out in an environment at a temperature of 22° C. and a humidity of 55% RH.

The strength is rated G0 to G3. The evaluation results are shown in Table 2.

G0: The folding endurance number is 100,000 or more.

G1: The folding endurance number is less than 100,000 and 50,000 or more.

G2: The folding endurance number is less than 50,000 and 10,000 or more.

G3: The folding endurance number is less than 10,000.

TABLE 1

| | First Resin | | Second Resin | | Conductive Agent B | |
|---|---|---|---|---|---|---|
| | Type | Amount (parts) | Type | Amount (parts) | Type | Amount (parts) |
| Example 1 | PA1 | 90 | PVB1 | 10 | CB1 | 13 |
| Example 2 | PA1 | 86 | PVB1 | 14 | CB1 | 13 |

TABLE 1-continued

| | First Resin | | Second Resin | | Conductive Agent B | |
|---|---|---|---|---|---|---|
| | Type | Amount (parts) | Type | Amount (parts) | Type | Amount (parts) |
| Example 3 | PA1 | 76 | PVB1 | 24 | CB1 | 13 |
| Example 4 | PA1 | 70 | PVB1 | 30 | CB1 | 13 |
| Comparative Example 1 | PA1 | 92 | PVB1 | 8 | CB1 | 13 |
| Example 5 | PA1 | 88 | PVB1 | 12 | CB1 | 13 |
| Example 6 | PI | 76 | PVB1 | 24 | CB1 | 13 |
| Example 7 | PA1 | 76 | PVA | 24 | CB1 | 13 |
| Example 8 | PA1 | 76 | PVB1 | 24 | tin oxide | 13 |
| Example 9 | PA1 | 76 | PVB1 | 24 | CB2 | 13 |
| Example 10 | PA1 | 76 | PVB1 | 24 | CB3 | 13 |
| Example 11 | PA1 | 76 | PVB1 | 24 | CB4 | 13 |
| Example 12 | PA1 | 76 | PVB1 | 24 | CB5 | 13 |
| Example 13 | PA1 | 76 | PVB1 | 24 | CB1 | 9 |
| Example 14 | PA1 | 76 | PVB1 | 24 | CB1 | 10 |
| Example 15 | PA1 | 76 | PVB1 | 24 | CB1 | 15 |
| Example 16 | PA1 | 76 | PVB1 | 24 | CB1 | 16 |
| Example 17 | PA1 | 89 | PVB1 | 11 | CB1 | 13 |
| Example 18 | PA1 | 71 | PVB1 | 29 | CB1 | 13 |
| Example 19 | PA1 | 69 | PVB1 | 31 | CB1 | 13 |
| Comparative Example 2 | PA1 | 91 | PVB1 | 9 | CB1 | 13 |
| Comparative Example 3 | PA1 | 95 | PVB1 | 5 | CB1 | 13 |
| Example 20 | PA1 | 60 | PVB1 | 40 | CB1 | 13 |
| Comparative Example 4 | PA1 | 55 | PVB1 | 45 | CB1 | 13 |

The "amount 1 (parts by mass)" of the second resin means the amount (unit: parts by mass) of the second resin with respect to 100 parts by mass of the total amount of the first resin and the second resin.

The "amount 2 (parts by mass)" of the second resin means the amount (unit: parts by mass) of the second resin with respect to 100 parts by mass of the first resin.

The "amount (parts by mass)" of the conductive agent means the amount (unit: parts by mass) of the conductive agent with respect to 100 parts by mass of the total amount of the first resin and the second resin.

The abbreviations of the type of first resin, the type of second resin, and the type of conductive agent in Table 2 have the same meanings as those in Table 1.

The foregoing results indicate that the conductive members according to Examples may eliminate or reduce color streaks in the axial direction generated during image formation and may have a surface layer that is less likely to break even if repeatedly deformed.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

TABLE 2

| | First Resin | | Second Resin | | | Conductive Agent | | | | | | | |
|---|---|---|---|---|---|---|---|---|---|---|---|---|---|
| | Type | Amount (parts by mass) | Type | Amount 1 (parts by mass) | Amount 2 (parts by mass) | Type | Average particle size (nm) | Amount (parts by mass) | Area occupancy of islands (%) | Diameter of islands (nm) | Average current value (μA) | Evaluation of image | Evaluation of strength |
| Example 1 | PA1 | 90 | PVB1 | 10 | 11 | CB1 | 16 | 13 | 10 | 100 | $1.9 \times 10^5$ | G2 | G0 |
| Example 2 | PA1 | 86 | PVB1 | 14 | 16 | CB1 | 16 | 13 | 15 | 300 | $4.0 \times 10^5$ | G1 | G0 |
| Example 3 | PA1 | 76 | PVB1 | 24 | 32 | CB1 | 16 | 13 | 25 | 400 | $5.8 \times 10^5$ | G0.5 | G0 |
| Example 4 | PA1 | 70 | PVB1 | 30 | 43 | CB1 | 16 | 13 | 40 | 500 | $1.2 \times 10^6$ | G0.5 | G1 |
| Comparative Example 1 | PA1 | 92 | PVB1 | 8 | 9 | CB1 | 16 | 13 | 9 | 85 | $1.5 \times 10^5$ | G3 | G0 |
| Example 5 | PA1 | 88 | PVB1 | 12 | 14 | CB1 | 16 | 13 | 13 | 150 | $3.9 \times 10^5$ | G1.5 | G0 |
| Example 6 | PI | 76 | PVB1 | 24 | 32 | CB1 | 16 | 13 | 13 | 100 | $8.0 \times 10^4$ | G2 | G0 |
| Example 7 | PA1 | 76 | PVA | 24 | 32 | CB1 | 16 | 13 | 13 | 50 | $1.0 \times 10^5$ | G2 | G1 |
| Example 8 | PA1 | 76 | PVB1 | 24 | 32 | tin oxide | 16 | 13 | 13 | 400 | $6.5 \times 10^5$ | G0.5 | G1 |
| Example 9 | PA1 | 76 | PVB1 | 24 | 32 | CB2 | 10 | 13 | 25 | 400 | $2.2 \times 10^5$ | G1.5 | G0 |
| Example 10 | PA1 | 76 | PVB1 | 24 | 32 | CB3 | 15 | 13 | 25 | 400 | $5.5 \times 10^5$ | G0.5 | G0 |
| Example 11 | PA1 | 76 | PVB1 | 24 | 32 | CB4 | 30 | 13 | 25 | 400 | $5.6 \times 10^5$ | G0.5 | G0 |
| Example 12 | PA1 | 76 | PVB1 | 24 | 32 | CB5 | 35 | 13 | 25 | 400 | $2.8 \times 10^5$ | G1.5 | G0 |
| Example 13 | PA1 | 76 | PVB1 | 24 | 32 | CB1 | 16 | 9 | 25 | 400 | $3.2 \times 10^5$ | G1.5 | G0 |
| Example 14 | PA1 | 76 | PVB1 | 24 | 32 | CB1 | 16 | 10 | 25 | 400 | $5.5 \times 10^5$ | G0.5 | G0 |
| Example 15 | PA1 | 76 | PVB1 | 24 | 32 | CB1 | 16 | 15 | 25 | 400 | $4.8 \times 10^5$ | G0.5 | G0 |
| Example 16 | PA1 | 76 | PVB1 | 24 | 32 | CB1 | 16 | 16 | 25 | 400 | $3.6 \times 10^5$ | G1.5 | G0 |
| Example 17 | PA1 | 89 | PVB1 | 11 | 12 | CB1 | 16 | 13 | 14 | 160 | $2.2 \times 10^5$ | G2 | G0 |
| Example 18 | PA1 | 71 | PVB1 | 29 | 41 | CB1 | 16 | 13 | 38 | 480 | $1.1 \times 10^6$ | G0.5 | G0 |
| Example 19 | PA1 | 69 | PVB1 | 31 | 45 | CB1 | 16 | 13 | 45 | 550 | $1.4 \times 10^6$ | G0.5 | G1 |
| Comparative Example 2 | PA1 | 91 | PVB1 | 9 | 10 | CB1 | 16 | 13 | 9.5 | 90 | $1.6 \times 10^5$ | G2.5 | G0 |
| Comparative Example 3 | PA1 | 95 | PVB1 | 5 | 5 | CB1 | 16 | 13 | 5 | 50 | $1.0 \times 10^5$ | G3 | G0 |
| Example 20 | PA1 | 60 | PVB1 | 40 | 67 | CB1 | 16 | 13 | 50 | 750 | $2.2 \times 10^6$ | G0.5 | G2 |
| Comparative Example 4 | PA1 | 55 | PVB1 | 45 | 82 | CB1 | 16 | 13 | 60 | 800 | $3.0 \times 10^6$ | G0.5 | G3 |

The abbreviations in Table 2 are as described below.

The "amount (parts by mass)" of the first resin means the amount (unit: parts by mass) of the first resin with respect to 100 parts by mass of the total amount of the first resin and the second resin.

What is claimed is:

1. A conductive member comprising:

a substrate;

an elastic layer on the substrate; and a surface layer on the elastic layer, wherein the surface layer comprises a conductive agent and has a sea-island structure including a sea comprising a first resin and islands comprising a second resin, and wherein an area occupancy of the islands in a cross section of the surface layer is 10% or more and 50% or less, wherein an amount of the second resin is 10 parts by mass or more and 30 parts by mass or less with respect to 100 parts by mass of a total amount of the first resin and the second resin, and wherein the amount of the second resin is 11 parts by mass or more and 43 parts by mass or less with respect to 100 parts by mass of the first resin.

2. A charging device comprising the conductive member according to claim 1.

3. A process cartridge comprising the charging device according to claim 2, wherein the process cartridge is attachable to and detachable from an image forming apparatus.

4. An image forming apparatus comprising:

an image holding member;

the charging device according to claim 2 configured to charge a surface of the image holding member;

an electrostatic latent image-forming device configured to form an electrostatic latent image on the charged surface of the image holding member;

a developing device configured to develop the electrostatic latent image on the surface of the image holding member by using a developer comprising a toner to form a toner image; and a transfer device configured to transfer the toner image to a surface of a recording medium.

5. A conductive member comprising:

a substrate;

an elastic layer on the substrate; and a surface layer on the elastic layer, wherein the surface layer comprises a conductive agent and has a sea-island structure including a sea comprising a first resin and islands comprising a second resin, wherein the islands have a diameter of 100 nm or more and 750 nm or less in a cross section of the surface layer, wherein an amount of the second resin is 10 parts by mass or more and 30 parts by mass or less with respect to 100 parts by mass of a total amount of the first resin and the second resin, and wherein the amount of the second resin is 11 parts by mass or more and 43 parts by mass or less with respect to 100 parts by mass of the first resin.

* * * * *